US010254072B2

(12) United States Patent
Danielsson et al.

(10) Patent No.: US 10,254,072 B2
(45) Date of Patent: Apr. 9, 2019

(54) DIFFERENTIAL COMPOUND BOW

(71) Applicant: Danielsson Innovation AB, Smedjebacken (SE)

(72) Inventors: Kurt Danielsson, Smedjebacken (SE); Alfons Falk, Bonässund (SE)

(73) Assignee: Danielsson Innovation AB, Smedjebacken (SE)

( * ) Notice: Subject to any disclaimer, the term of this patent is extended or adjusted under 35 U.S.C. 154(b) by 0 days.

(21) Appl. No.: 15/950,001

(22) Filed: Apr. 10, 2018

(65) Prior Publication Data

US 2018/0292165 A1 Oct. 11, 2018

(30) Foreign Application Priority Data

Apr. 11, 2017 (SE) ..... 1750435-8

(51) Int. Cl.
*F41B 5/10* (2006.01)

(52) U.S. Cl.
CPC ..... *F41B 5/105* (2013.01); *F41B 5/10* (2013.01)

(58) Field of Classification Search
CPC ..... F41B 5/10; F41B 5/105
See application file for complete search history.

(56) References Cited

U.S. PATENT DOCUMENTS 3,851,638 A 12/1974 Alexander
4,512,326 A * 4/1985 Jarrett ..... F41B 5/10 124/25.6
4,722,317 A * 2/1988 Hartwig ..... F41B 5/10 124/25.6
4,858,588 A * 8/1989 Bozek ..... F41B 5/0094 124/23.1
5,388,564 A * 2/1995 Islas ..... F41B 5/0094 124/23.1
6,776,148 B1 * 8/2004 Islas ..... F41B 5/10 124/25.6
6,792,931 B1 * 9/2004 Schaar ..... F41B 5/10 124/25.6
7,578,289 B2 * 8/2009 Norkus ..... F41B 5/0094 124/25
8,387,604 B1 3/2013 Terzo
9,273,921 B2 * 3/2016 Koch ..... F41B 5/10
9,297,604 B1 * 3/2016 Sidebottom ..... F41B 5/123
10,048,037 B2 * 8/2018 Peacemaker ..... F41B 5/10
2007/0101980 A1 5/2007 Sims
(Continued)

OTHER PUBLICATIONS

Elite 2015 Technical Manual; (https://s3.amazonaws.com/elite-website/documents/techmanuals/2015_techmanual.pdf); Dated: 2015; pp. 16.

*Primary Examiner* — John Ricci
(74) *Attorney, Agent, or Firm* — Lowe Graham Jones PLLC

(57) ABSTRACT

A bow system and an idler wheel for the bow system (1) is provided. The bow system comprises a first limb (3) and a second limb (4), a riser (2) interconnecting the first (3) and second (4) limbs, a first (5) and a second (6) idler wheel, and a bowstring (9) arranged between the first (5) and the second (6) idler wheel. The first idler wheel (5) is rotationally journalled in a first end portion of the riser (2) and the second idler wheel (6) is rotationally journalled in a second end portion of the riser (2) such that both idler wheels (5, 6) are stationary when the bow system (1) is tensioned.

18 Claims, 4 Drawing Sheets

(56) References Cited

U.S. PATENT DOCUMENTS

| | | | | |
|---|---|---|---|---|
| 2014/0190460 | A1 | 7/2014 | Langley | |
| 2015/0136105 | A1* | 5/2015 | McPherson | F41B 5/105 124/25.6 |

* cited by examiner

DIFFERENTIAL COMPOUND BOW

PRIORITY CLAIM

This application claims priority from Swedish Application Serial No. SE 17504358 filed Apr. 11, 2017, which is hereby incorporated by reference.

TECHNICAL FIELD

The present invention relates to archery equipment and more precisely to a compound bow.

BACKGROUND OF THE INVENTION

Bows have been used for a very long time and many improvements have been made during the years. The most recent type of bow is the compound bow. The compound bow uses pulleys or cams in order to maximize the energy that is stored in the tensioned bow. A compound bow comprises two idler wheels, one located on the top portion and one on the bottom portion of the bow, which reels out the bowstring in a non-linear relationship against limb bending or pull. To enable this functionality, there is a need for "span ratio" which can be different between compound bow designs.

The wheels work together in a force balance configuration. Each of these wheels have cams to variate bowstring reel out versus limb pull. To enlarge the span that can be directly achieved from the cam system, high force cables connect between the upper and lower idler wheel arrangements. A problem with such compound bows is that the idler wheels are moving mainly vertically when the bowstring is tensioned and released, making it more or less impossible to synchronize the rotation of the upper and lower idler wheels respectively. A synchronized rotation of both wheels is desirable since it reduces the hit dispersion.

A well-known problem in the art is nock travel, which directly influences hit dispersion. When the idler wheel is carried on the limb tops, a number of error sources makes the bowstring groove in the idler wheel to move sideways resulting in horizontal nock travel. One example of such error source is from limbs not having equal characteristics over the full draw, making the idler wheel to twist. This means that the nocking point of the bowstring is not mowing in a straight line after release.

Another error source is unsymmetrical loading to risers and limb systems making the system bend or twist. Sideways unsymmetrical risers are commonly used in opposite to shoot through solutions that can be symmetrical. The unsymmetrical riser has a central part at the arrow rest, which is located to the side of the bowstring to enable free passage of the arrow fins, resulting in a sideways bending of the whole system. The arrow nocking point will not move in a straight line after release.

In a conventional compound bow, idler wheel rotation depends on a force balance between upper and lower limbs resulting in a vertical nock travel as the two idler wheels are not rotating synchronously. Since the idler wheels are moving, it is more or less impossible to eliminate this error source by a synchronizing system.

Another problem with prior art compound bows is that it has a draw stop, which acts against the high force interconnecting limb cable, i.e. the draw stop is a soft stop. For an unskilled shooter, this will result in considerable draw length variations that results in errors from variations in arrow speed and making the bow string peep sight move up and down. Variations in the shooter's draw length will result in dispersion primarily at long shooting distances.

Prior art compound bows are disclosed in U.S. Pat. No. 6,776,148B1, U.S. Pat. No. 3,851,638A, US451236A, U.S. Pat. No. 8,387,604B1 and disclose bows with idler wheels which are movably arranged, and thereby contributing to a large hit dispersion. From the above it is understood that there is room for improvements.

SUMMARY OF THE INVENTION

An object of the present invention is to provide a new type of compound bow which is improved over prior art and which eliminates or at least mitigates the drawbacks discussed above. More specifically, an object of the invention is to provide a bow with reduced hit dispersion and a bowstring nock position which moves in a straight line when the bow is released. This is accomplished by a compound bow without high force cables between the upper and lower idler wheels and which idler wheels are fixed, which improves bow efficiency and reduces nock travel. These objects are achieved by the technique set forth in the appended independent claims with preferred embodiments defined in the dependent claims related thereto.

In a first aspect of the invention, an idler wheel for a bow system is provided. The bow system comprises a set of limb cables having a first end and a second end, the idler wheel comprises a bow string groove, a primary cam arranged on a first side of the bowstring groove and provided with a primary cam groove, a secondary cam arranged on a second side of the bowstring groove and provided with a secondary cam groove, wherein the primary cam groove is configured to receive the first end of the limb cable and wherein the secondary cam groove is configured to receive the second end of the limb cable for a pull and release function. This wheel and the pull and release function allows for a differential principle in the bow system making the bow more accurate.

In one embodiment, the primary cam is cylindrical. With a cylindrical cam, the pull and release function is a smooth, even movement.

In a second aspect, a bow system is provided which comprises a first limb and a second limb, a riser interconnecting the first and second limbs, a first and a second idler wheel, and a bowstring arranged between the first and the second idler wheel, wherein the first idler wheel is rotationally journalled in a first end portion of the riser and the second idler wheel is rotationally journalled in a second end portion of the riser such that both idler wheels are stationary when the bow system is tensioned. Advantages with this construction is e.g. a decreased dynamic loss at the idler wheels when the arrow is released from the bow system since the idler wheels are stationary, and are only rotating In one embodiment, the system further comprises a first and a second limb cable attachable to the first and the second idler wheel respectively for a pull and release function. The pull and release function provides the bow with improved accuracy since it is provided with a differential functionality which enables control of energy transfer from the bow string draw to stored potential limb energy.

In another embodiment, a first end of each limb cable is attachable to the primary cam groove and a second end of each limb cable is attachable to the secondary cam groove of each idler wheel. Further, the primary cam groove is configured to pull and the secondary cam groove is configured to release the limb cable. Thus, the pull and release functionality is obtained.

Preferably, at a substantially non-tensioned mode of the system, the limb cables are wound up in the secondary cam groove of each idler wheel.

The limb cable may be configured to be reeled out from the secondary cam groove and reeled in on the primary cam groove when the system is tensioned.

The system may further comprise at least one circular limb idler wheel arranged on the distal end of each limb. It is advantageous to use limb idler wheels for guiding the limb cables.

Preferably, the bow system comprises a first limb system and a second limb system, each limb system comprising at least one limb, a limb idler wheel, a limb cable, and an idler wheel. Each limb system is configured to provide the bow system with limb pull independent of the other limb system. An advantage is that contributions to parasitic loss from moving masses connected to the limb system is reduced. Lower parasitic losses mean that the arrow speed increases, which in turn reduces influences from factors such as side wind.

In one embodiment, each limb system comprises dual limbs. The bow system may further comprise a synchronizing system configured to make the idler wheels run synchronously. The synchronization system may comprise at least two synchronizing strings arranged in a first synchronizing string groove and a second synchronizing string groove of each idler wheel respectively. It is advantageous to have a synchronization system since it makes the bow system symmetrical.

In a preferred embodiment, the synchronizing strings are of the same length such that symmetry around the second symmetry line is obtained. The symmetry cannot be manipulated or destroyed by a user.

As an option, the synchronization system further comprises a tensioning device arranged on the riser for limiting slack in the synchronizing strings and to distribute equal force to the first and second idler wheel. The location of the tensioner at the bow center line will provide for fully symmetric idler wheel angular positions independent of applied adjusting force.

In one embodiment, the tensioning device further comprises a spring for temperature compensation.

In another embodiment, the idler wheels are arranged such that the bowstring groove is located on a first symmetry line of the bow system. The symmetry of the bow system makes the nock position to move in a straight line, which improves the hit accuracy.

The system is preferably symmetrical in relation to a second symmetry line arranged between the first and second idler wheel. This defined symmetry line does not vary with the draw length, and thanks to it, the rear end of an arrow to be released is in a stable position, which reduces hit dispersion.

Optionally, the system comprises a rigid draw-stop provided by the stationary idler wheels. This is advantageous since it reduces the hit dispersion of the bow system. Preferably, the draw-stop is adjustable. This provides for a possibility for each user to adapt the bow after his/her individual preferences.

DETAILED DESCRIPTION OF EMBODIMENTS

Hereinafter, certain embodiments will be described more fully with reference to the accompanying drawings. The invention may, however, be embodied in many different forms and should not be construed as limited to the embodiments set forth herein; rather, these embodiments are provided by way of example so that this disclosure will be thorough and complete, and will fully convey the scope of the invention, such as it is defined in the appended claims, to those skilled in the art.

Figure 1:
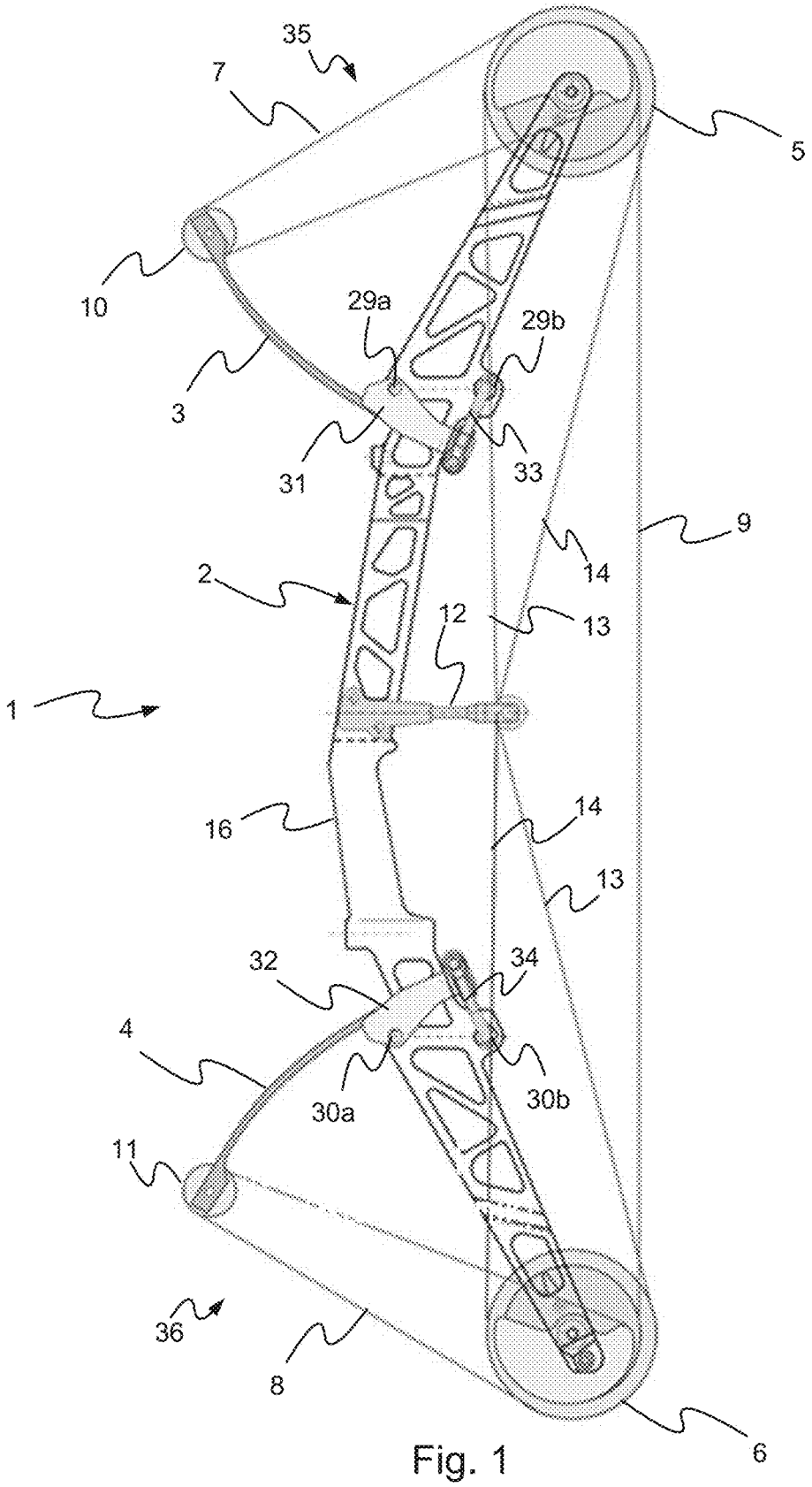
FIG. 1 is a side view of a bow system.

In FIG. 1, a compound bow 1 is disclosed. It comprises a riser 2, a first limb 3 and a second limb 4 arranged on the riser 2. When the bow is in use the first limb 3 will be located above the second limb 4, therefore, the first limb 3 will in the following also be referred to as an upper limb 3, and the second limb 4 will also be referred to as a lower limb 4. The riser 2 is provided with two pairs of attachment points 29*a*, 29*b*, 30*a*, 30*b* into which two adjustable limb carriers 31, 32 are mounted. Each pair of attachment points 29*a*, 29*b*, 30*a*, 30*b* comprises a forward attachment point 29*a*, 30*a* and a rear attachment point 29*b*, 30*b*. The forward attachment 29*a*, 30*a* is a pivot point around which the limb carrier 31, 32 is rotatable in order to be adjustable. The rear attachment point 29*b*, 30*b* is for a reaction member 33, 34 giving an angular setting of the limb carriers 31, 32 in a conventional way. A limb idler wheel 10, 11 is arranged in the distal end of each limb 3, 4 respectively. Further, a shooter's grip 16 is located in the middle portion of the riser 2.

The bow 1 further comprises a first (in use upper) idler wheel 5 and a second (in use lower) idler wheel 6. The idler wheels 5, 6 are connected to the limbs 3, 4 by means of limb cables 7, 8 running between each limb idler wheel 10, 11 and idler wheel 5, 6. Between the two idler wheels 5, 6, a bowstring 9 is arranged. The first and second (or upper and lower) limb systems comprising the limbs, the limb idler wheels, the idler wheels and the limb cables are mirror pictures of each other, which contributes to the symmetry of bow. The limb idler wheels 10, 11 are of low weight and inertia in order to facilitate the reeling of the limb cables 7, 8.

The bow 1 is provided with a synchronizing system which includes a tensioning device arranged on the riser 2 and a first and a second synchronizing string 13, 14 arranged between the idler wheels 5, 6, and the tensioning device 12. The tensioning device 12 removes possible slack in the synchronizing strings 13, 14. The tensioning device 12 further includes a spring for compensating for temperature variations, primarily related to elongation of the riser 2. See FIG. 10. The synchronizing strings 13, 14 are arranged to make the idler wheels 5, 6 rotate synchronal. This procedure will be more thoroughly described below.

Figure 2:
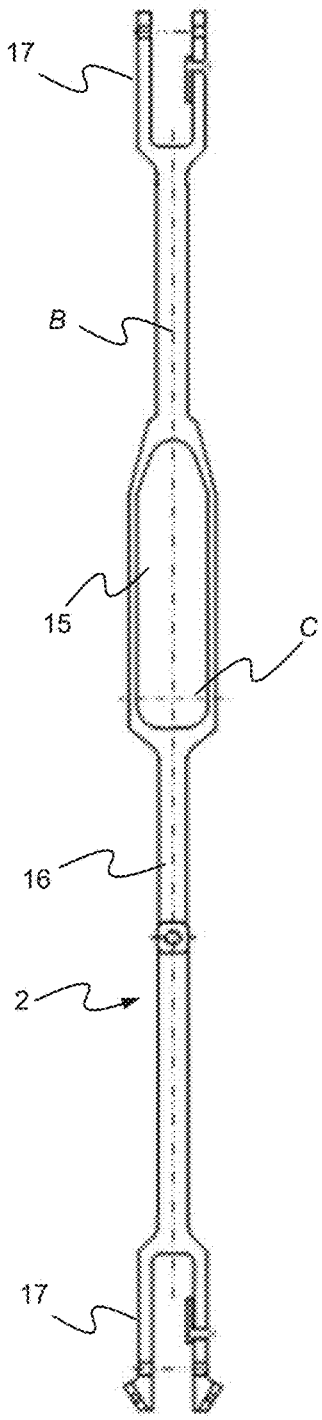
FIG. 2 is a front view of a riser of the bow system.
Figure 8:
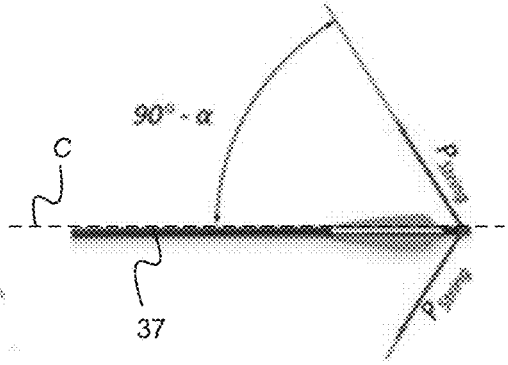
FIG. 8 is a side view of an arrow to be released.

In FIG. 2, the riser 2 is disclosed in front view. The riser 2 has two symmetry lines, one symmetry line B extending along the longitudinal extension of the bow 1, and a second symmetry line C extending perpendicularly against the first symmetry line B. The second symmetry line C is located between the idler wheels 5, 6. The bow 1 is symmetrically built in relation to the two symmetry lines B, C, which enables a stable bow 1 with low error contributions. An arrow 37 to be shot is placed with its center on the symmetry line C (shown in FIG. 8).

A sight and shoot through window 15 is arranged in the riser 2, which also contributes to the symmetry of the riser 2. The window 15 is located above the shooter's grip 16 to lower the vertical bow 1 rotation at arrow release and it enables free arrow passage and an undisturbed shooter's view of a sight (not shown) mounted in front of the riser 2. In both ends of the riser 2 forks 17 are provided in which the idler wheels 5, 6 are rotatably journalled. The riser 2 is preferably manufactured in one piece and is of a skeleton type design in order to reduce weight. In order to reduce the vertical rotation of the bow 1 stabilizers (not shown) may be attached to the riser 2 in a conventional way. The stabilizers may be a single forward stabilizer provided directly under the shooter's grip together with two sideways stabilizers located low at the riser 2 pointing both rearwards and downwards.

Figure 3:
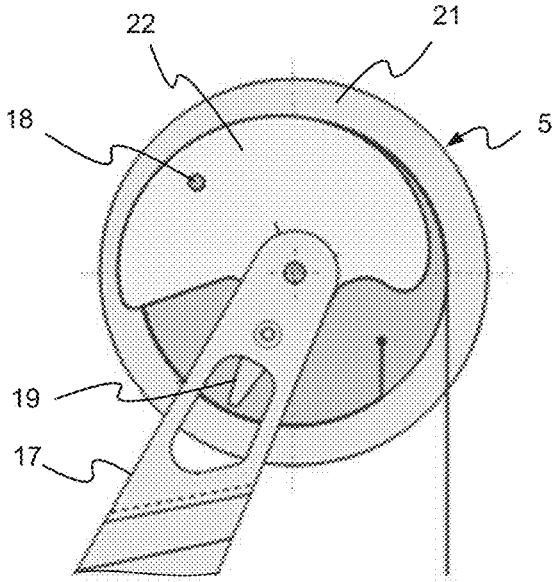
FIG. 3 is a detail of an idler wheel of FIG. 1.
Figure 4:
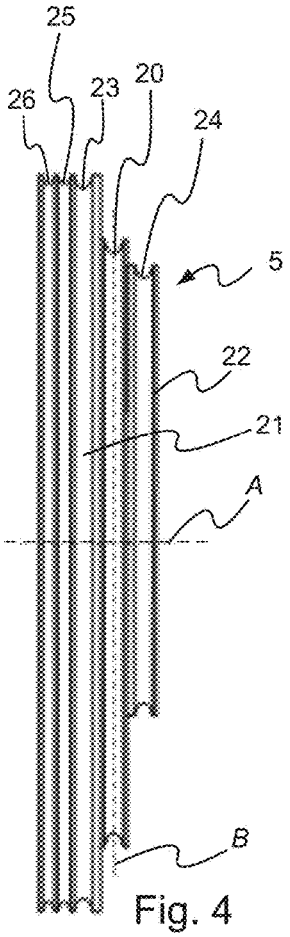
FIG. 4 is a side view of the idler wheel of FIG. 3.
Figure 5:
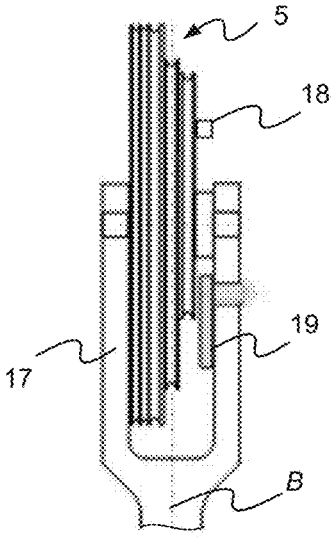
FIG. 5 is a side view of the idler wheel of FIGS. 3 and 4.

Referring to FIGS. 3-5, one of the idler wheels 5, 6 is disclosed from the side, from the front and rotatably journalled in the riser 2, respectively. The idler wheel 5, 6 has a fixed stop pin 18 and the riser 2 has an adjustable stop lever 19 against which the stop pin 18 works. Together the stop pin 18 and the stop lever 19 form a firm draw stop.

As is best disclosed in FIG. 4, the wheel 5 has five grooves, all carried by a common axis A. A bowstring groove 20, preferably circular, is located in line with the first bow symmetry line B. The bowstring 9 is wounded onto this groove 20, enabling the bowstring 9 to reel out when it is pulled by the shooter.

A primary 21 and a secondary 22 cam are located at equal distances from the first bow symmetry line B on each side of the bowstring groove 20. The cams 21, 22 are each provided with cam grooves 23, 24. Next to the primary cam 21, there are two cylindrical grooves 25, 26 for the synchronizing strings 13, 14. The primary cam 21 is preferably cylindrical and with similar groove diameter as the synchronizing grooves 25, 26.

The above disclosure is also valid for the opposite idler wheel 6, since the system is mirror symmetrical.

Figure 6:
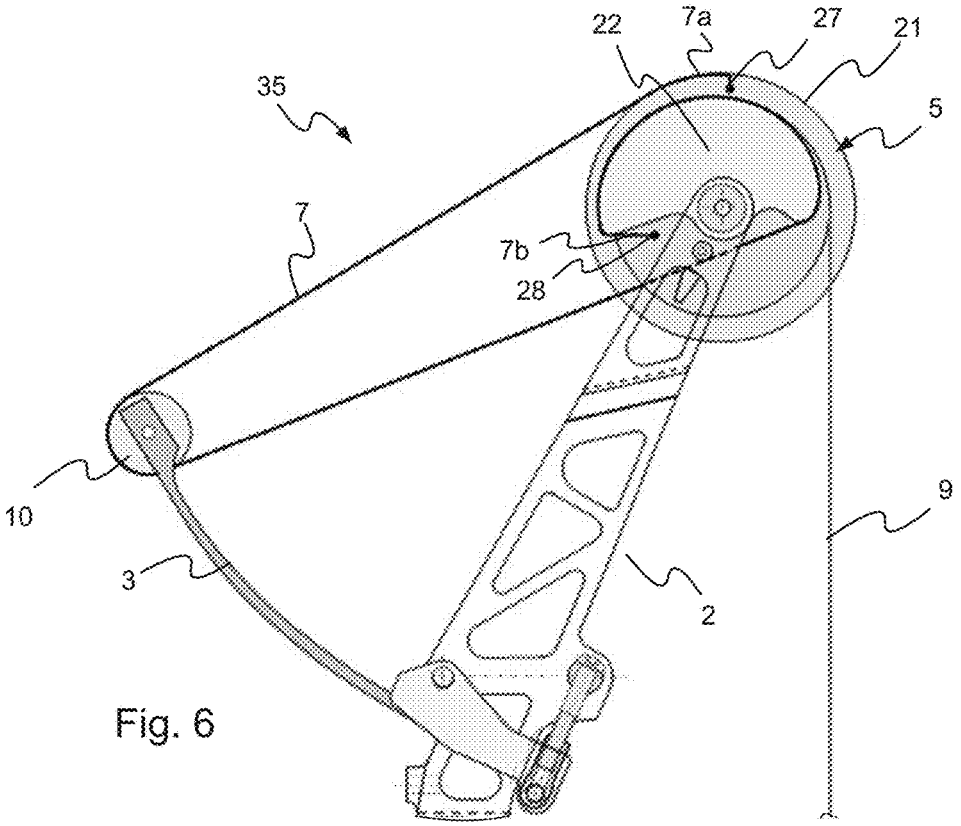
FIG. 6 is a detail of a part of the bow system of FIG. 1.

Now referring to FIG. 6, disclosing the upper portion of the bow 1, the differential compound functionality of the bow 1 will be explained.

The differential compound functionality is achieved by a one-piece limb cable 7 having both of its ends fixed to the idler wheel 5. The first end 7*a* of the limb cable 7 is anchored in an anchoring location 27 on the primary cam 21, and the second end 7*b* of the limb cable 7 is anchored in a second anchoring location 28 on the idler wheel 5. The limb cable 7 is thus arranged so that the primary cam 21 can reel in the limb cable 7 and the secondary cam 22 can reel it out.

When the bow 1 is drawn, the primary cam 21 rotates with the idler wheel 5, and thus the limb idler wheel 10 is pulled. The secondary cam 22 has a working radius below the idler wheel axis A and by that it gives a release to the limb cable 7 enabling large radiuses to the primary 21 and secondary 22 cams. A circular primary cam 21 gives that the draw force curve is fully given by the secondary cam 22 giving release to the limb cable 7. To enable standardization, the secondary cam 22 is preferably detachable as a separate part.

Figure 7:
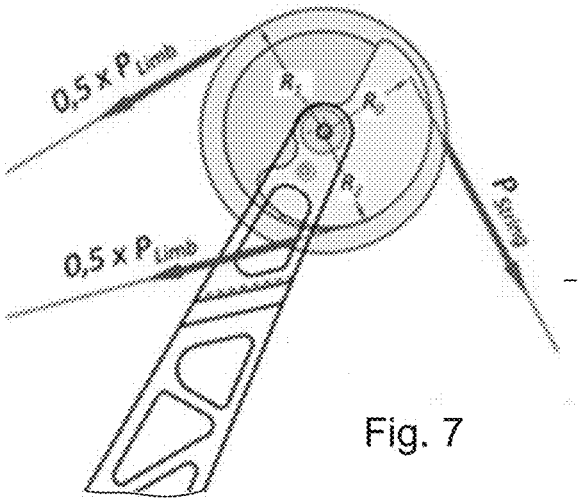
FIG. 7 is a detail of the system of FIG. 1, disclosing torque forces.

The primary cam 21 pull L1 is reduced by 50% at the limb idler wheel 10 due to the pulley function. As a 50% reduction is present also for the secondary cam release L2, the limb pull S is: $S=0.5\times(L1-L2)$ This relationship is the key to enable large cam curves and by that, a stationary idler wheel 5 is obtained. A stationary idler wheel is associated with advantages to bow efficiency and accuracy. L1 and L2 can be directly calculated with the bowstring angle $\alpha$ to vertical as a base enabling calculation of limb pull S. See FIGS. 7 and 8.

Figure 9:
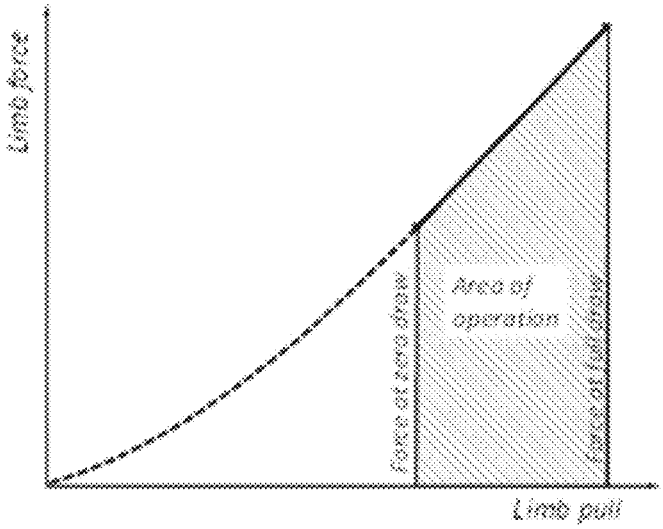
FIG. 9 is a limb force deflection curve.

With knowledge of the limb force deflection curve, see FIG. 9, the limb force can be calculated as a function of the shooter's draw.

Torque balance gives (see FIG. 7):

$$0.5\times P_{Limb}\times(R_1-R_2)=P_{String}\times R_O$$

$$P_{String}=P_{Limb}\times(R_1-R_2)2\times R_O$$

$$P_{Draw}=2\times P_{string}\times\sin\propto$$

From an ergonomic point of view, the first part of the draw gives if the bow 1 is easy to draw or not. The differential compound bow 1 enables different draw force curve characteristics such as light, medium or hard. This is primarily given by the bowstring force at zero draw and the radius R2.

The fixed draw stop 18, 19 also enables the possibility to freely locate draw force curve energy during the draw, i.e. it opens up for more energy to be stored at the end of the draw where the human body is strong, enabling increased arrow speed.

The above disclosure is also valid for the lower portion of the bow 1, since the system is mirror symmetrical.

The bow 1 also comprises a low force synchronizing system. The differential system and the synchronizing system may be used separately or in combination. The synchronizing system includes a symmetric tensioning system which absorbs possible slack and which includes a tensioner built to allow for temperature elongation of the riser.

Figure 10:
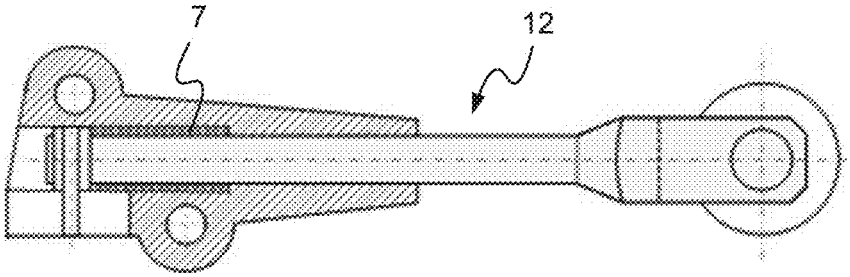
FIG. 10 is a side view of a tensioning device.

Again referring to FIG. 1, and to FIG. 10, the synchronizing system comprises two strings 13, 14, and a tensioning device 12 located at the second bow symmetry line C, making the bow 1 symmetric. The tensioning device 12 is displaced in relation to the first bow symmetry line B. The tensioning device 12 takes away possible slack in the two synchronizing strings 13, 14 for accurate rotational control.

The two synchronizing strings 13, 14 are of the same length for symmetry that enables true mirror positions of the idler wheels 5, 6 during the draw. The synchronizing strings 13, 14 are only tensioned to a relatively low force to avoid sideways deflection of the riser 2. The result of the synchronizing system is reduced or no nock travel.

The first synchronizing string 13 has an anchor at the first upper idler wheel 5 allowing the first synchronizing string 13 to reel in to this upper wheel 5. At the second, lower idler wheel 6, the string 13 is wound around the wheel 6 as a buffer in the first synchronizing string groove 25 (see FIG. 4) and the anchor of the first synchronizing string 13 is located to allow for reel out of the string 13.

The opposite is valid for the second synchronizing string 14, i.e. the second synchronizing string 14 is attached with a buffer in the second synchronizing string groove 26 on the first, upper idler wheel 5, from where it may be reeled out. The other end of the second string 14 is attached to the second synchronizing string groove 26 of the lower idler wheel 6, where it may be reeled in the groove 26.

The location of the tensioning device 12 at the second bow symmetry line C will ensure fully symmetric idler wheel 5, 6 angular positions independent of applied adjusting force.

It should be mentioned that the present invention is by no means limited to the embodiments described above, and many modifications are feasible within the inventive idea set forth in the appended claims. For instance, the idler wheel design can be applied to slightly different assemblies, such as compound bows or compound crossbows.

The embodiments of the invention in which an exclusive property or privilege is claimed are defined as follows:

1. An idler wheel for a bow system comprising a set of limb cables having a first end and a second end, the idler wheel comprising a bow string groove, a primary cam arranged on a first side of the bowstring groove and provided with a primary cam groove, a secondary cam arranged on a second side of the bowstring groove and provided with a secondary cam groove, wherein the primary cam groove is configured to receive the first end of the limb cables and wherein the secondary cam groove is configured to receive the second end of the limb cables for a pull and release function.

2. The idler wheel according to claim 1, wherein the primary cam is cylindrical.

3. A bow system comprising a first limb and a second limb, a riser interconnecting the first and second limbs, a first and a second idler wheel according to claim 1, a bowstring arranged between the first and the second idler wheel, wherein the first idler wheel is rotationally journalled in a first end portion of the riser and the second idler wheel is rotationally journalled in a second end portion of the riser such that both idler wheels are stationary when the bow system is tensioned.

4. The bow system according to claim 3, further comprising a first and a second limb cable attachable to the first and the second idler wheel respectively for a pull and release function.

5. The bow system according to claim 3, wherein a first end of each limb cable is attachable to the primary cam groove and a second end of each limb cable is attachable to the secondary cam groove of each idler wheel, and wherein the primary cam groove is configured to pull and the secondary cam groove is configured to release the limb cable.

6. The bow system according to claim 3, wherein, at a substantially nontensioned mode of the system, the limb cables are wound up in the secondary cam groove of each idler wheel.

7. The bow system according to claim 3, wherein the limb cable is configured to be reeled out from the secondary cam groove and reeled in on the primary cam groove when the system is tensioned.

8. The bow system according to claim 3, further comprising at least one circular limb idler wheel arranged on the distal end of each limb.

9. The bow system according to claim 3, comprising a first limb system and a second limb system, each limb system comprising at least one limb, a limb idler wheel, a limb cable, and an idler wheel, wherein each limb system is configured to provide the bow system with limb pull independent of the other limb system.

10. The bow system according to claim 3, wherein each limb system comprises dual limbs.

11. The bow system according to claim 3, further comprising a synchronizing system configured to make the idler wheels run synchronously, wherein the synchronization system comprises at least two synchronizing strings arranged in a first synchronizing string groove and a second synchronizing string groove of each idler wheel respectively.

12. The bow system according to claim 3, wherein the synchronizing strings are of the same length.

13. The bow system according to claim 3, wherein the synchronization system further comprises a tensioning device arranged on the riser for limiting slack in the synchronizing strings and to distribute equal force to the first and second idler wheel.

14. The bow system according to claim 3, wherein the tensioning device further comprises a spring for temperature compensation.

15. The bow system according to claim 3, wherein the idler wheels are arranged such that the bowstring groove is located on a first symmetry line of the bow system.

16. The bow system according to claim 3, wherein the system is symmetrical in relation to a second symmetry line arranged between the first and second idler wheel.

17. The bow system according to claim 3, wherein the system comprises a rigid draw-stop provided by the stationary idler wheels.

18. The bow system according to claim 3, wherein the draw-stop is adjustable.

* * * * *